United States Patent [19]

Bacon et al.

[11] Patent Number: 4,564,430

[45] Date of Patent: Jan. 14, 1986

[54] CONTINUOUS CONTACT PLATING APPARATUS

[75] Inventors: Jeffery E. Bacon, Long Beach; James E. Craig, South Pasadena; Mark K. Pedersen, Yorba Linda, all of Calif.

[73] Assignee: Robbins & Craig Welding & Mfg. Co., South El Monte, Calif.

[21] Appl. No.: 654,760

[22] Filed: Sep. 25, 1984

[51] Int. Cl.[4] ..... C25D 17/00; C25D 17/14

[52] U.S. Cl. ..... 204/206; 204/224 R

[58] Field of Search ..... 204/15, 206, 224 R, 204/198, 202, 203, 204, 205

[56] References Cited

U.S. PATENT DOCUMENTS

| | | | |
|---|---|---|---|
| 2,591,042 | 4/1952 | Berman | 204/202 |
| 3,661,752 | 5/1972 | Capper | 204/206 |
| 3,951,772 | 4/1976 | Bick | 204/15 |
| 4,064,019 | 12/1977 | Eidschun | 204/224 R |
| 4,452,684 | 6/1984 | Palnik | 204/206 |

*Primary Examiner*—T. M. Tufariello

*Attorney, Agent, or Firm*—Price, Gess & Ubell

[57] ABSTRACT

A contact plater apparatus and method for plating selected areas of a web workpiece wherein the web workpiece and anode are in close proximity, separated only by the brush belt that contacts the web workpiece. A box manifold continually replenishes with plating solution, provides the brush belt with plating solution from openings in a header as the solution passes over an anode. The brush belt of open-cell foam or other absorbent material wicks up the plating solution and brushes it on the desired spot on the cathodic web workpiece. The brush belt is guided past the box manifold in an accurately defined path. The web workpiece and brush belt are brought into contact at the openings in the header of the box manifold where the plating takes place. The brush belt has a continuous loop of backing material that has considerable structural stability and is impervious to the plating fluid. The absorbent material is carried by this backing material. The belt is structured so that it is structurally stable, impervious to the plating solution and only applies the minimum amount of required plating solution to the desired zone on the web workpiece.

17 Claims, 7 Drawing Figures

CONTINUOUS CONTACT PLATING APPARATUS

BACKGROUND OF THE INVENTION

1. Field of the Invention

The present invention relates generally to improvements in plating apparatus, and more particularly pertains to new and improved zone plating apparatus wherein precious metals such as gold, silver or palladium are plated on electrical contact areas on electrical components.

2. Brief Description of the Prior Art

Those concerned with the development of plating apparatus for plating precious metals such as gold and silver or palladium onto electrical components have long recognized the need for efficiency in the application of the precious metal to the workpiece, both in terms of control over the defined area that is plated and the thickness of the plating material. U.S. Pat. No. 4,064,019 for a continuous contact plater method issued Dec. 20, 1977 describes a system which is directed towards this end. However, the system falls short in several respects. It fails to accurately control the thickness of the precious metal being deposited on the selected area of the electrical components. It fails to plate an accurately defined area. It can only plate one zone on a component at a time. It is designed to plate curved surfaces. The present invention overcomes the shortcomings of the apparatus in U.S. Pat. No. 4,064,019 and all the prior art in this field. Specifically, the present invention can plate multiple zones, at one time, including front and back. It is also capable of plating flat or curved surfaces on a component.

SUMMARY OF THE INVENTION

The present selective contact plater apparatus and method provide the minimum necessary amount of plating solution to the web workpiece and plates at minimum thickness on curved or flat surfaces, multiple zones at one time, by keeping the anode very close to the web workpiece and utilizing a continuous brush belt that only touches the web workpiece with the electrified plating solution at the desired zone. The belt is constructed using materials and methods that make it structurally stable and impervious to the plating solution and also only apply a minimum amount of plating solution to the web. The belt moves against and across the web at a rate of speed that facilitates efficient plating.

BRIEF DESCRIPTION OF THE DRAWINGS

The objects and many of the attendant advantages of this invention will be readily appreciated as the same becomes better understood by reference to the following detailed description when considered in conjunction with the accompanying drawings in which like references numerals designate like parts throughout the figures thereof, and wherein.

DESCRIPTION OF THE PREFERRED EMBODIMENT

Figure 1:
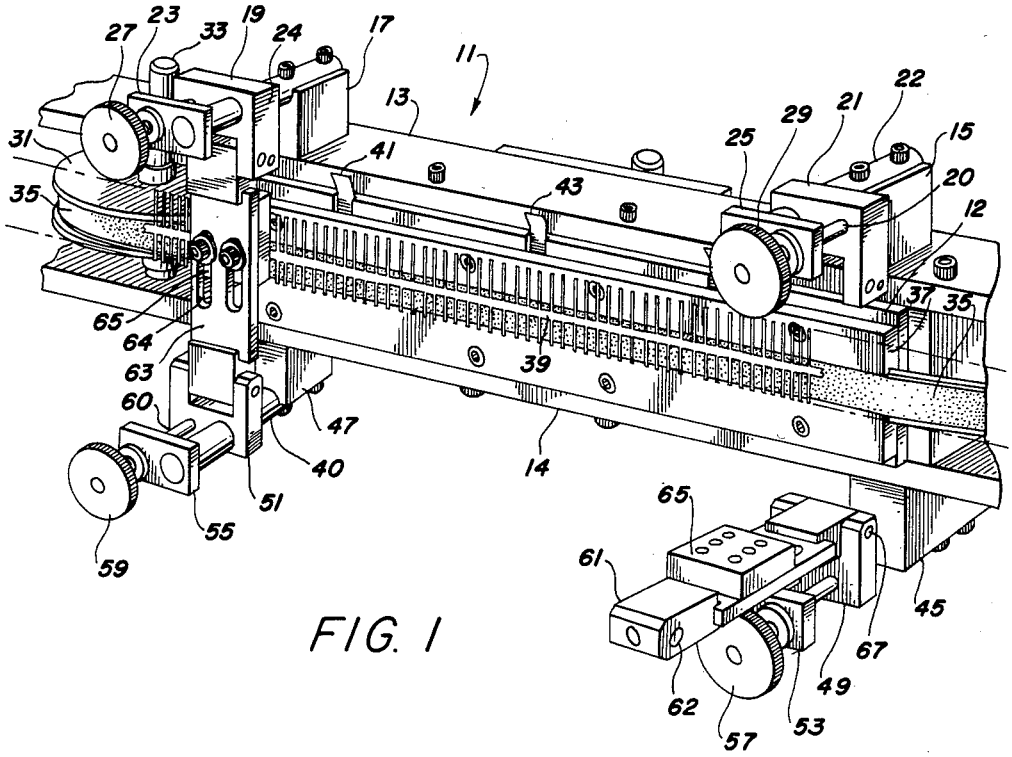
FIG. 1 is a perspective illustration of the continuous contact plating apparatus of the present invention.

Referring first to FIG. 1, which illustrates the major features of the continuous contact plating apparatus 11 according to the present invention, a web workpiece 39 is shown coming into contact with the brush belt 35 which effectively plates selective portions of the continuous web workpiece 39. The web workpiece 39 is essentially a continuous web or a strip containing many pieces of electrical components which are to be selectively plated with a precious metal electrical conductor such as gold, palladium or silver, for example. The web workpiece 39, as is understood in the art, is charged cathodically. The manner in which this is accomplished is not shown. Neither are the takeup and supply reels which cause the web workpiece 39 to move past the contained supply of plating solution 12 and the brush belt 35.

Figure 7:
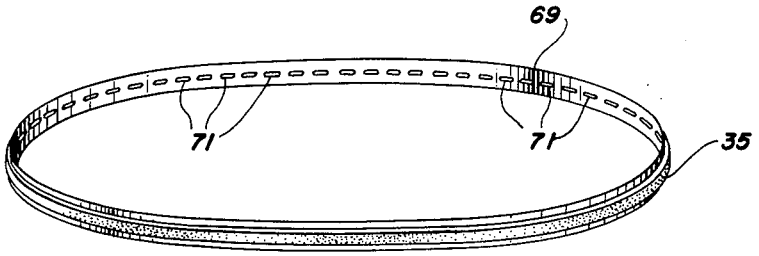
FIG. 7 is a perspective of the brush belt utilized by the continuous contact plating apparatus of the present invention.

The brush belt 35, as is more clearly seen in FIG. 7, is a continuous loop having a backing 69 that is structurally stable and chemically inert to the plating solution utilized. A material such as titanium is preferred. This backing has a plurality of apertures 71 punched therein along its length to allow plating solution fluid to pass therethrough to the brush portion 35, which is highly absorbent material and chemically inert to the plating solution. An open cell urethane foam or other materials such as felt or neoprene is preferred. The absorbent material must be capable of allowing the solution to pass through from one side to the other and be held by the material.

The brush belt 35 moves over a series of pulleys, only one of which is shown, 31. Pulley 31 can be considered the driving pulley that moves the belt past the face or header 12 of the contained supply of plating solution. Pulley 31 is rotated by driving its rotary shaft 33.

The contained supply of plating solution and its header 12, as well as the guide 37 for the brush belt 35 which is fastened thereto, is contained within a framework which has an upper shelf 13 and a lower shelf 14. The upper shelf 13 carries support structures 15 and 17 which in turn support latching blocks 21 and 19, respectively. Latching blocks 21 and 19 are moved back and forth on their respective shafts by way of knobs 29 and 27, respectively. Knob 29, for example, drives the threaded shaft 20 which threadably engages latching block 21, causing it to move back and forth on carrier shaft 22.

A similar type of adjustable mechanism is utilized at the bottom plate 14 for the plater apparatus. Support blocks 45 and 47 support hinge blocks 49 and 51, respectively, by way of circular shafts such as 40, for example. The knob-screw apparatus 57 and 59, respectively, turn within screw support plates 53 and 55, respectively, to rotate bolt 60, for example, which threadably engages pivotal block 51, causing it to ride back and forth on support shaft 40.

To ensure that the web workpiece 39 makes correct contact with the brush belt 35 moving within the pathway 37, a contact arm such as 63, which is pivotally connected to pivot block 51, is swung up and engaged with latching block 19 by way of a dowel pin 24, for example, which slides through the latching block 19 into its respective connecting head. The workings of the contact arm are more clearly illustrated when unlatched on the right-hand side of FIG. 1, wherein the contact block 65 is clearly illustrated. The connecting head 61 has an aperture 62 therein for receiving the connecting pin. The contact block 65 can be positioned on the arm 63 by way of moving the block in the slots 64 therein by loosening the thumbscrews 65. Once disconnected from connecting block 21, the entire contact arm may be pivoted down around pivot hinge 67.

Figure 2:
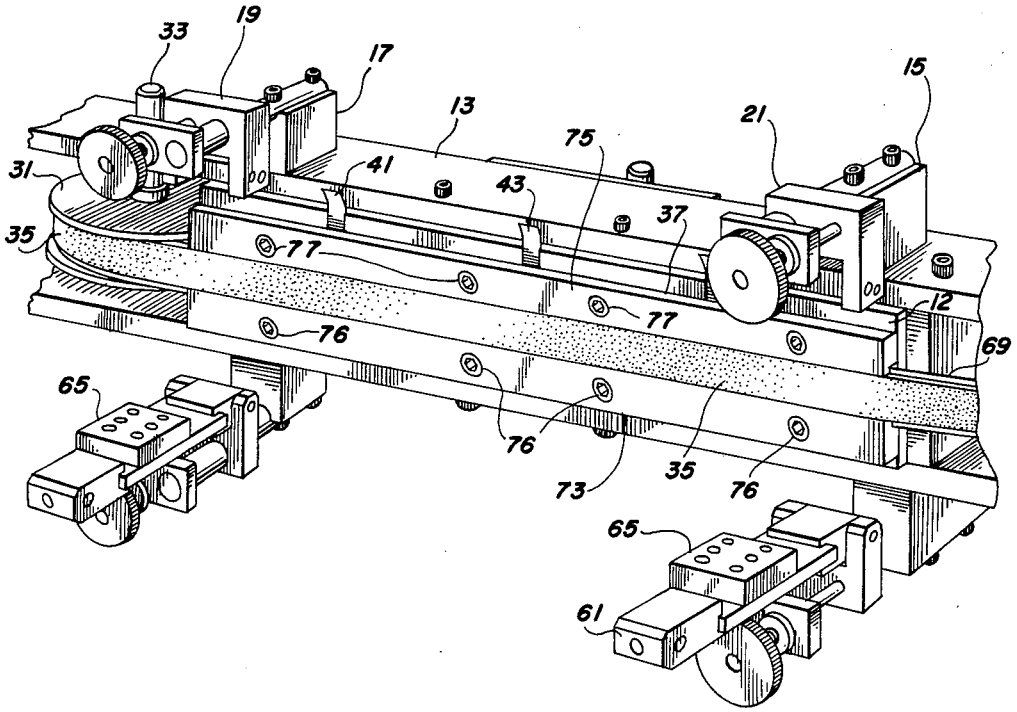
FIG. 2 is a partial perspective illustration of a continuous contact plating apparatus showing the brush belt.

Referring now to FIG. 2, the guide means 37 for the brush belt 35 is more clearly illustrated. The brush belt guide 37 has a pair of major parts, upper fastening bar 75 and lower fastening bar 73, which fasten to the front of the contained supply of plating solution 12 by way of countersunk bolts 77 in the upper bar 75 and bolts 76 in the lower bar 73. Both the upper and lower bar 75 and 73, respectively, overlay the edges 69 of the brush belt 35, thereby guiding it across the face of the contained supply plating solution 12 in both a horizontal and vertical direction.

Located behind the guide 37 is the anode which has electrical connector arms 41 and 43 shown in FIG. 2 to which electrical connection is made.

Figure 3:
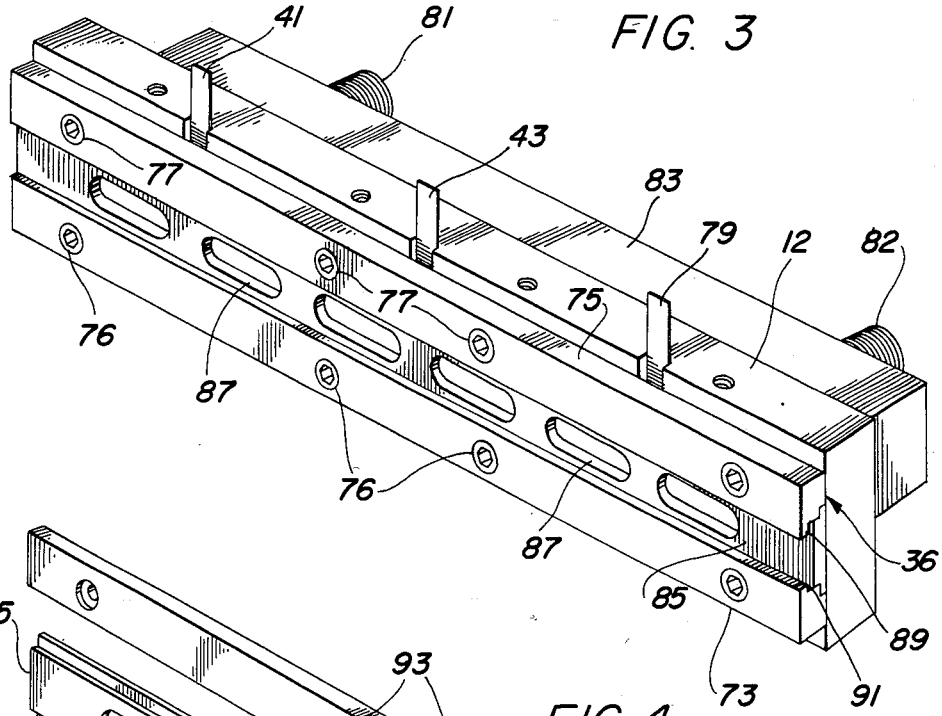
FIG. 3 is a perspective of the continuous contact plating apparatus showing the guide device of the brush belt attached to the plating fluid chamber.

Referring now to FIG. 3, the contained supply of plating solution 12 is more clearly illustrated, as is the brush belt guide 36. The contained supply of plating solution 12 is essentially a box manifold 83 which has an inlet port 81 and an outlet port 82 through which plating solution flows. The plating solution can escape from the box manifold 83 and pass through the apertures 87 in slide bar 85, which is part of the brush belt guide 36. Apertures 87 are shown as formed to match the apertures in the titanium backing for the brush belt. However, such an arrangement should not be taken as limiting. Again, the electrical connector tabs 41, 43 and 79 for the anode located within the avenue of escape for the plating solution from the box manifold 83 are shown.

Figure 4:
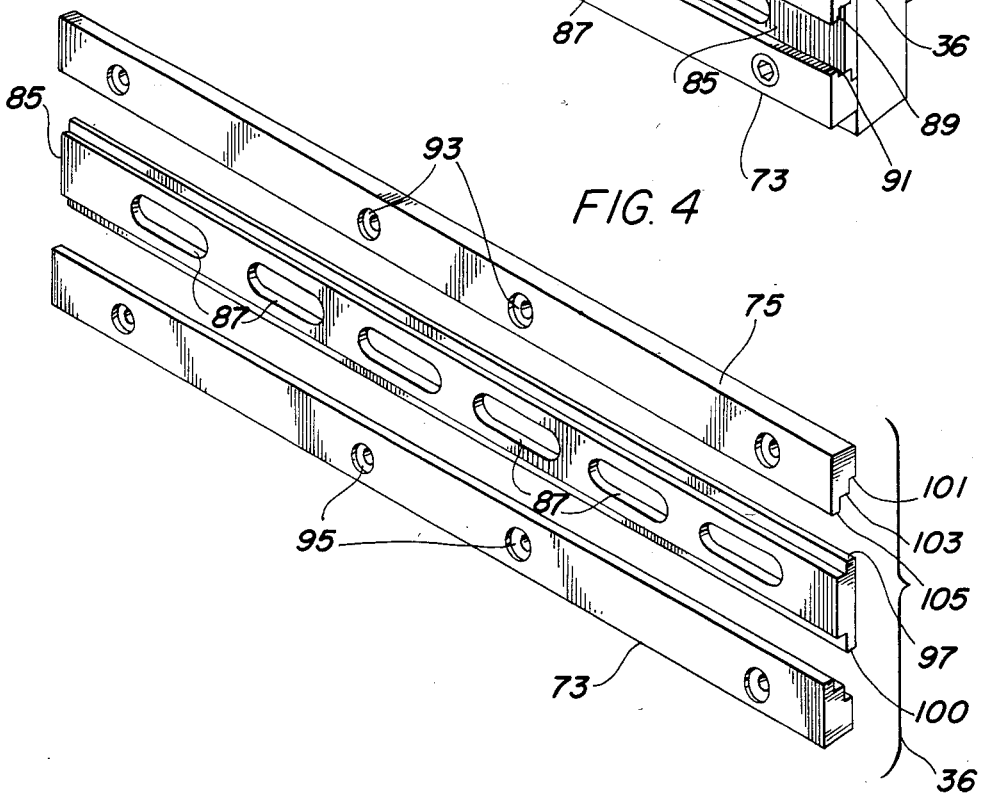
FIG. 4 is an exploded perspective showing the three main parts of the guide for the brush belt.

Referring now to FIG. 4, the major parts of the brush belt guide mechanism 36 are most clearly illustrated. Essentially, the brush belt guide mechanism 36 is made up of three parts. The slide bar 85, as already discussed, has a plurality of apertures located therein and stepped edges having two steps 99 and 97 at both edges of approximately equal distance. This slide bar 85 is preferably made out of a high density and smooth material like TEFLON or TIVAR or material having similar characteristics. Slide bar 85 overlays the front of the box manifold 83 and covers the avenue of escape of the plating solution out of the box manifold 83. It is held fast to the front by means of the upper fastening bar 75 and the lower fastening bar 73. Both the upper bar 75 and lower bar 73 have a three-step edge, 101, 103 and 105, which overlays the two-step edge on the slide bar 85. However, the middle step 103 of the fastening bars is greater than the first step 99 of the slide bar so that a gap 89 and 91, respectively, slightly greater than the thickness of the titanium metal ribbon which backs the brush belt is created, allowing the brush belt to slide within that gap. Also, the distance between the first step 99 of the top edge and first step 100 of the bottom edge of slide bar 85 is slightly greater than the width of the brush belt titanium backing. The apertures 93 in the upper fastening bar 75 and the apertures 95 in the lower fastening bar 73 are countersunk apertures to receive the Allen head bolts 77 and 76, respectively.

Figure 5:
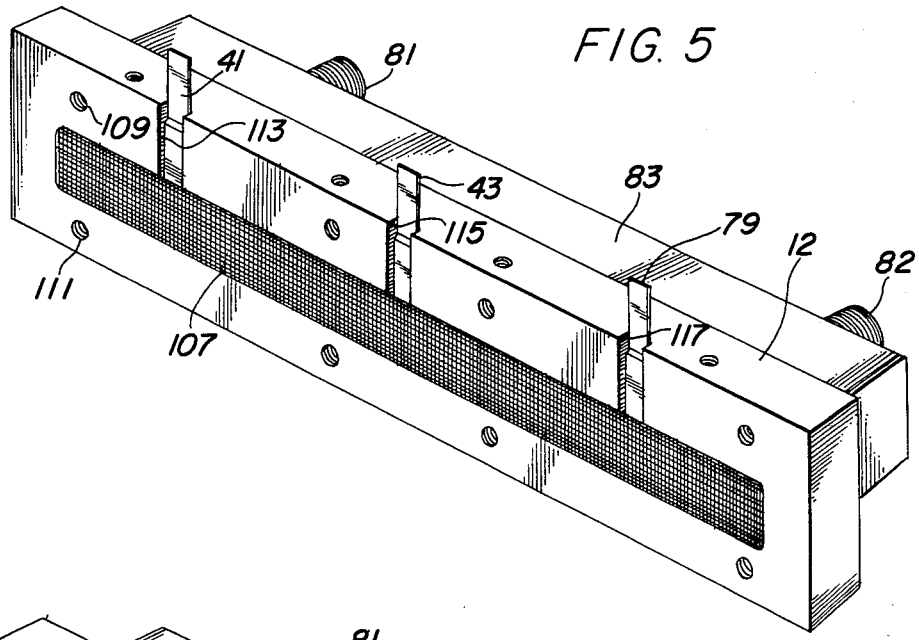
FIG. 5 is a perspective of a portion of the continuous contact plating apparatus according to the present invention showing the anode positioned with respect to the plating solution chamber.

Referring now to FIG. 5, the preferred anodic structure to be used with the box manifold 83 is illustrated. The anode 107 is shown as a mesh or screen of platinum clad material, preferably platinum wire or other chemically inert material having similar characteristics, which has electrical connector tabs 41, 43 and 79 connected thereto and extending therefrom in channels 113, 115 and 117, respectively. The anode 107 lies within a recess 109 (FIG. 6) in the face of the box manifold 83, thereby providing a flat surface for the guide. Three pieces of the brush belt guide 36 to overlay the apertures 109 and 111 in the face of the box manifold 83 are threaded to receive the Allen head bolts that pass through the upper fastening bar 75 and lower fastening bar 73 of the brush belt guide apparatus 36.

Figure 6:
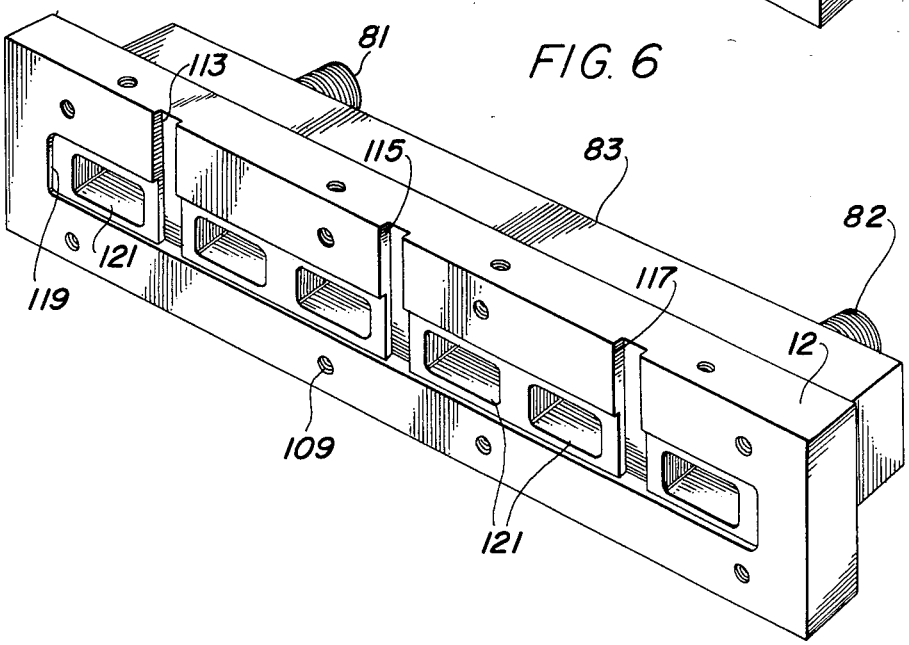
FIG. 6 is a perspective showing a portion of the continuous contact plater apparatus of the present invention, the anode chamber and the escape channels for the plating solution.

FIG. 6 more clearly illustrates the avenue of escape for the plating solution contained within the box manifold 83. The apertures 121 in the face of the box manifold are structured to correspond to the apertures 87 in the slide bar 85 of the brush belt guide apparatus 36. However, such an arrangement should not be considered as limiting, as other relationships may be found useful. The box manifold 83 is made of PVC material or some other material of equally inert characteristics to the plating solution.

The brush belt essentially has two major components, a loop of material which is a carrier for the loop of absorbent material which is the brush. The carrier is preferably a flat titanium ribbon of 10 mil thickness. It could also be made out of fiberglass plastic or similar material which has structural stability and is chemically inert to the plating solution utilized. Assuming the titanium ribbon is used as the carrier, it is formed into a loop by welding the two ends together. Then the apertures are placed therein approximately along a line that is at the center of its width, which apertures are of a desired length and width as may be, to some extent, dictated by the particular electrical components being plated.

An adhesive which can withstand the pH ranges and temperature ranges to which the brush belt will be subjected is utilized to glue the absorbent brush material to the carrier. The adhesive must be chemically inert to the plating solution utilized and must be compatible with the brush material that is being glued to the titanium loop.

A foam, felt, neoprene or similar material which will be the brush portion of the brush belt is formed to be of about equal width with the titanium loop and of equal length. It is preferred that an open cell urethane foam be utilized which has homogeneous pores and grain structure. It has been found that such a material exhibits excellent capillary action in drawing plating solution quickly from the contained supply in the box manifold to the surface that is to contact the electrical apparatus to be plated.

In operation, the belt is the carrier for the plating fluid in that it transmits the plating solution from the box manifold to the exact area on the part being plated, applying it by a brushing lateral movement across that area. The plating solution delivered by the brush belt is electrically charged. The belt is driven in a direction opposite to or with the web workpiece at a speed that will most effectively break down the cathodic film buildup on the interface or contact point between the brush belt and web workpiece.

It should be understood that the foregoing disclosure relates only to the preferred embodiments of the invention and that modifications may be made therein without departing from the spirit and scope of the invention as set forth in the appended claims. For example, a squeegee apparatus may be placed at a location on the brush belt after it passes by the contained source of supply for the plating solution in order to squeeze out the plating solution remaining in the belt after the plating operation. In addition, plating solution may be added to the brush belt at a place other than from the box manifold and in addition to the solution provided to the belt by the box manifold.

Although the method and apparatus described is most advantageously usable with systems for plating gold, other materials and platable substances can be plated by the method and apparatus, such as silver, palladium, copper, nickel, tin or tin/lead, for example. Indeed, the system could also be used to selectively strip metals from a workpiece or apply lubricant thereto, or remove a fluid therefrom.

What is claimed is:

1. A selective contact plater for continuously plating a plurality of zones, comprising:

a manifold, having plating solution therein, with a header having at least one opening for allowing the solution to pass through;

an anode mounted in close proximity to the opening in the header so that all plating solution leaving the manifold must pass over the anode;

a slide bar sealably mounted to the header over the anode and the opening in the header, said slide bar having openings therein for directing flow of the plating solution from the manifold after it passes over the anode;

a continuous loop of material that is structurally stable and inert to the plating solution, having openings therein that are related to the openings in said slide bar, said loop contacting said slide bar and moving lengthwise along the surface thereof;

porous material for absorbing the plating solution fixedly mounted to said continuous loop of stable and inert material overlaying the openings therein, on the side opposite to the one contacting said slide bar; and means for moving a series of parts to be selectively plated past said porous material along its length so that the areas to be plated on each part contacts the porous material.

2. The selective contact plater of claim 1 wherein said manifold, has an inlet and outlet coupling, for permitting, a continuous flow of solution therethrough.

3. The selective contact plater of claim 1 wherein said anode comprises a wire screen that fits within the opening in the header of the manifold.

4. The selective contact plater of claim 1 wherein said continuous loop of structurally stable material comprises titanium and said absorbent material comprises an open-cell foam.

5. The selective contact plater of claim 4 wherein said open-cell foam is a polyurethane material having a uniform grain structure.

6. The selective contact plater of claim 5 wherein said open-cell foam material is held to said titanium belt by an adhesive capable of withstanding the pH and temperature ranges in the plating process.

7. The selective contact plater of claim 1 further comprising a means for guiding said continuous loop lengthwise along the surface of said slide bar over the openings therein.

8. The selective contact plater of claim 7 wherein said guiding means comprises a relatively friction-free material that is structurally stable and impervious to the pH and temperature ranges of the plating solution.

9. The selective contact plater of claim 8 wherein said guide means comprises two parts, the first part and second part overlaying the edges of the slide bar and holding it fast to the header of the manifold.

10. The selective contact plater of claim 9 wherein said first and second parts further overlay the edges of said continuous loop, thereby guiding it in a defined path over the slide bar.

11. The selective contact plater of claim 1 wherein said slide bar comprises a relatively friction-free material that is structurally stable and impervious to the pH and temperature range of the plating solution.

12. In combination with a selective contact plater for continuously plating a plurality of areas, on a series of parts, the improvement therein comprising a belt for applying charged plating solution to the parts, the belt comprising:

a continuous loop of structurally stable material, inert to the plating solution, having aperatures therein; and absorbent material mounted on the continuous loop to overlay the holes therein for applying the charged plating solution to the parts.

13. The improvement of claim 12 wherein the continuous loop with apertures therein comprises a ribbon of titanium with apertures spaced along its length.

14. The improvement of claim 13 wherein said absorbent material is a continuous loop mounted over the apertures in the ribbon of titanium.

15. The improvement of claim 14 wherein the absorbent material comprises an open cell foam.

16. The improvement of claim 15 wherein the open cell foam has a density factor of five or greater.

17. The improvement of claim 16 wherein the foam is contoured to complement the areas being plated.

* * * * *